US011247460B2

(12) United States Patent
Sugiura et al.

(10) Patent No.: US 11,247,460 B2
(45) Date of Patent: Feb. 15, 2022

(54) LIQUID DISCHARGING HEAD

(71) Applicant: Brother Kogyo Kabushiki Kaisha, Nagoya (JP)

(72) Inventors: Keita Sugiura, Toyokawa (JP); Shohei Koide, Nagoya (JP); Keita Hirai, Nagoya (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/851,868

(22) Filed: Apr. 17, 2020

(65) Prior Publication Data

US 2020/0384762 A1 Dec. 10, 2020

(30) Foreign Application Priority Data

Jun. 5, 2019 (JP) ..... JP2019-105485

(51) Int. Cl.
*B41J 2/14* (2006.01)

(52) U.S. Cl.
CPC ..... *B41J 2/14* (2013.01); *B41J 2002/14403* (2013.01)

(58) Field of Classification Search
CPC ..... B41J 2/14; B41J 2002/14403; B41J 2002/14419; B41J 2002/14459; B41J 2/14233; B41J 2202/12
See application file for complete search history.

(56) References Cited

U.S. PATENT DOCUMENTS

| | | | | |
|---|---|---|---|---|
| 9,688,076 | B2 | 6/2017 | Sugahara et al. | |
| 9,950,538 | B2 | 4/2018 | Sugahara et al. | |
| 10,583,657 | B2 | 3/2020 | Sugiura | |
| 2011/0102519 | A1* | 5/2011 | Koseki ..... | B41J 2/14209 347/71 |
| 2016/0288499 | A1 | 10/2016 | Sugahara et al. | |
| 2019/0084303 | A1 | 3/2019 | Sugiura | |

FOREIGN PATENT DOCUMENTS

| | | | |
|---|---|---|---|
| JP | 2016-190431 | A | 11/2016 |
| JP | 2019-055492 | A | 4/2019 |

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid discharging head includes: a first member having a surface in which first openings are formed, the first openings arranged in a first direction and communicating with individual channels; a second member disposed at one side in a second direction with respect to the first member, the second member having: a space extending in the first direction and communicating with the first openings; and a second opening disposed at the first side in the second direction with respect to the space and communicating with the space; and a third member disposed between the first member and the second member in the second direction and having a communicating hole extending in the first direction and allowing the first openings to communicate with the space. The third member has a wall dividing the communicating hole into partial holes separated from each other in the first direction.

11 Claims, 9 Drawing Sheets

LIQUID DISCHARGING HEAD

CROSS REFERENCE TO RELATED APPLICATION

The present application claims priority from Japanese Patent Application No. 2019-105485 filed on Jun. 5, 2019, the disclosure of which is incorporated herein by reference in its entirety.

BACKGROUND

Field of the Invention

The present disclosure relates to a liquid discharging head including a first member, a second member, and a third member, the first member having first openings that communicate with individual channels, the second member having a space that communicates with the first openings, the third member disposed between the first member and the second member and having a communicating hole that allows the first openings to communicate with the space.

Description of the Related Art

There is known a liquid discharging head including: a plate (first member) having inflow openings (first openings) that communicate with individual channels; a channel member (second member) having a channel (space) that communicates with the inflow openings; and a plate (third member) disposed between the plate and the channel member and having a common inflow channel (communicating hole) that allows the inflow openings of the plate to communicate with the channel of the channel member. The inflow openings are arranged in a scanning direction (first direction), and the common inflow channel extends in the scanning direction.

SUMMARY

In the above liquid discharging head, the plate (third member) is formed to have the common inflow channel (communicating hole) that is long in the scanning direction (first direction). In that configuration, the rigidity of the third member decreases, which may reduce the flatness of the third member. The decrease in flatness of the third member may cause adhesion failure between the first member and the second member, which may cause liquid leakage.

An object of the present disclosure is to provide a liquid discharging head that is capable of inhibiting the decrease in flatness of a third member.

According to an aspect of the present disclosure, there is provided a liquid discharging head, including: a first member having a surface in which first openings are formed, the first openings being arranged in a first direction parallel to the surface and communicating with individual channels; a second member disposed at one side in a second direction, which is orthogonal to the surface, with respect to the first member, the second member having: a space that extends in the first direction and communicates with the first openings; and a second opening that is disposed at the one side in the second direction with respect to the space and communicates with the space; and a third member disposed between the first member and the second member in the second direction and having a communicating hole that extends in the first direction and allows the first openings to communicate with the space, wherein the third member has a wall dividing the communicating hole into partial holes separated from each other in the first direction.

DESCRIPTION OF THE EMBODIMENTS

First Embodiment

Figure 1:
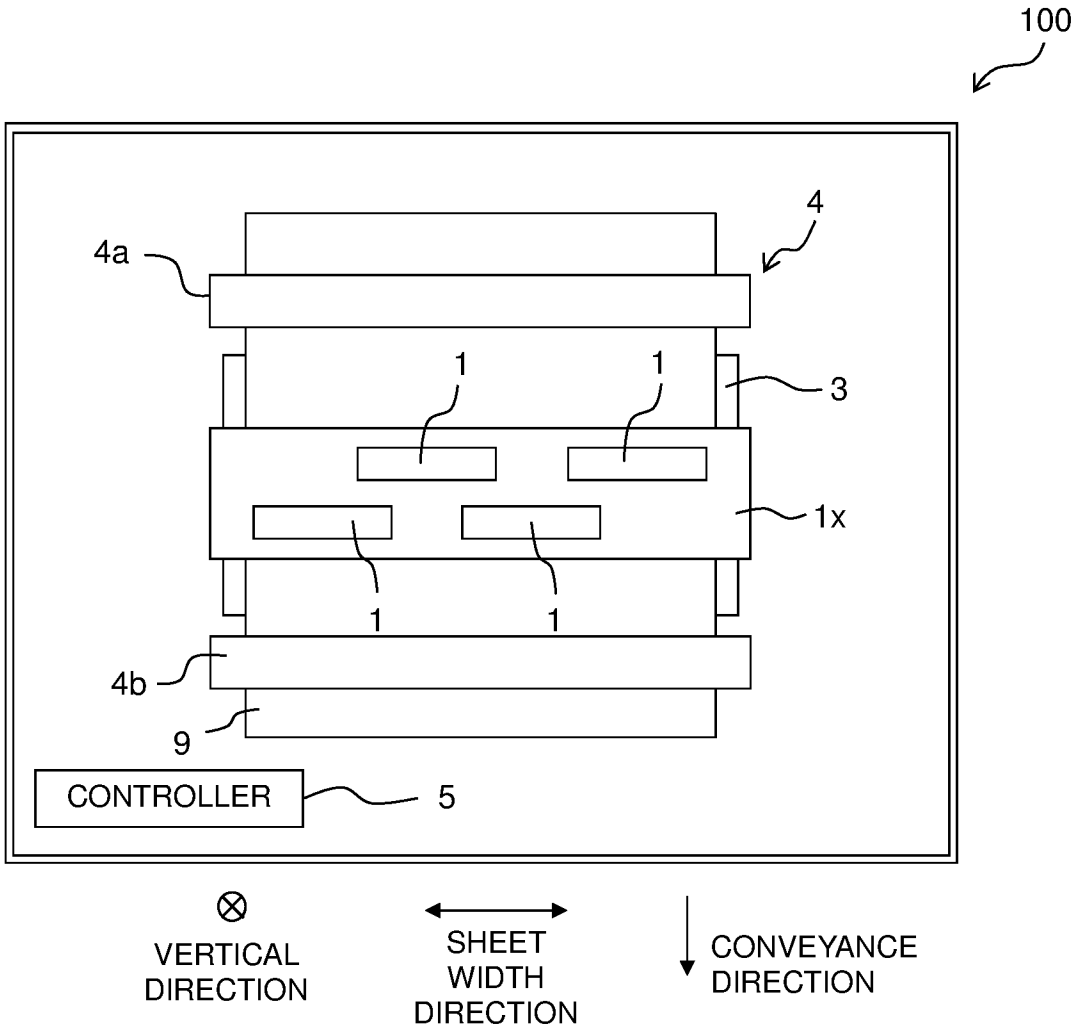
FIG. 1 is a plan view of a printer including heads according to the first embodiment of the present disclosure.

Referring to FIG. 1, a schematic configuration of a printer 100 including heads 1 according to the first embodiment of the present disclosure is explained.

The printer 100 includes a head unit 1*x* including the four heads 1, a platen 3, a conveyer 4, and a controller 5.

A sheet 9 is placed on an upper surface of the platen 3.

The conveyer 4 includes two roller pairs 4*a* and 4*b* disposed to interpose the platen 3 therebetween in a conveyance direction. When a conveyance motor (not depicted) is driven by the control of the controller 5, the roller pairs 4*a* and 4*b* nipping the sheet 9 rotate and the sheet P is conveyed in the conveyance direction.

The head unit 1*x* is long in a sheet width direction (direction orthogonal to the conveyance direction and a vertical direction). The head unit 1*x* is a line-type head unit in which ink is discharged from nozzles 21 (see FIGS. 2 and 3) on the sheet 9 in a state that the head unit 1*x* is fixed or secured to the printer 100. The four heads 1, which are long in the sheet width direction, are arranged zigzag in the sheet width direction.

The controller 5 includes a Read Only Memory (ROM), a Random Access Memory (RAM), and an Application Specific Integrated Circuit (ASIC). The ASIC executes recording processing and the like in accordance with programs stored in the ROM. In the recording processing, the controller 5 controls a driver IC (not depicted) for each head 1 and the conveyance motor (not depicted) based on a recording instruction (including image data) input from an external apparatus, such as a PC, to record an image on the sheet 9.

Referring to FIGS. 2 to 7, a configuration of the head 1 is explained.

Figure 2:
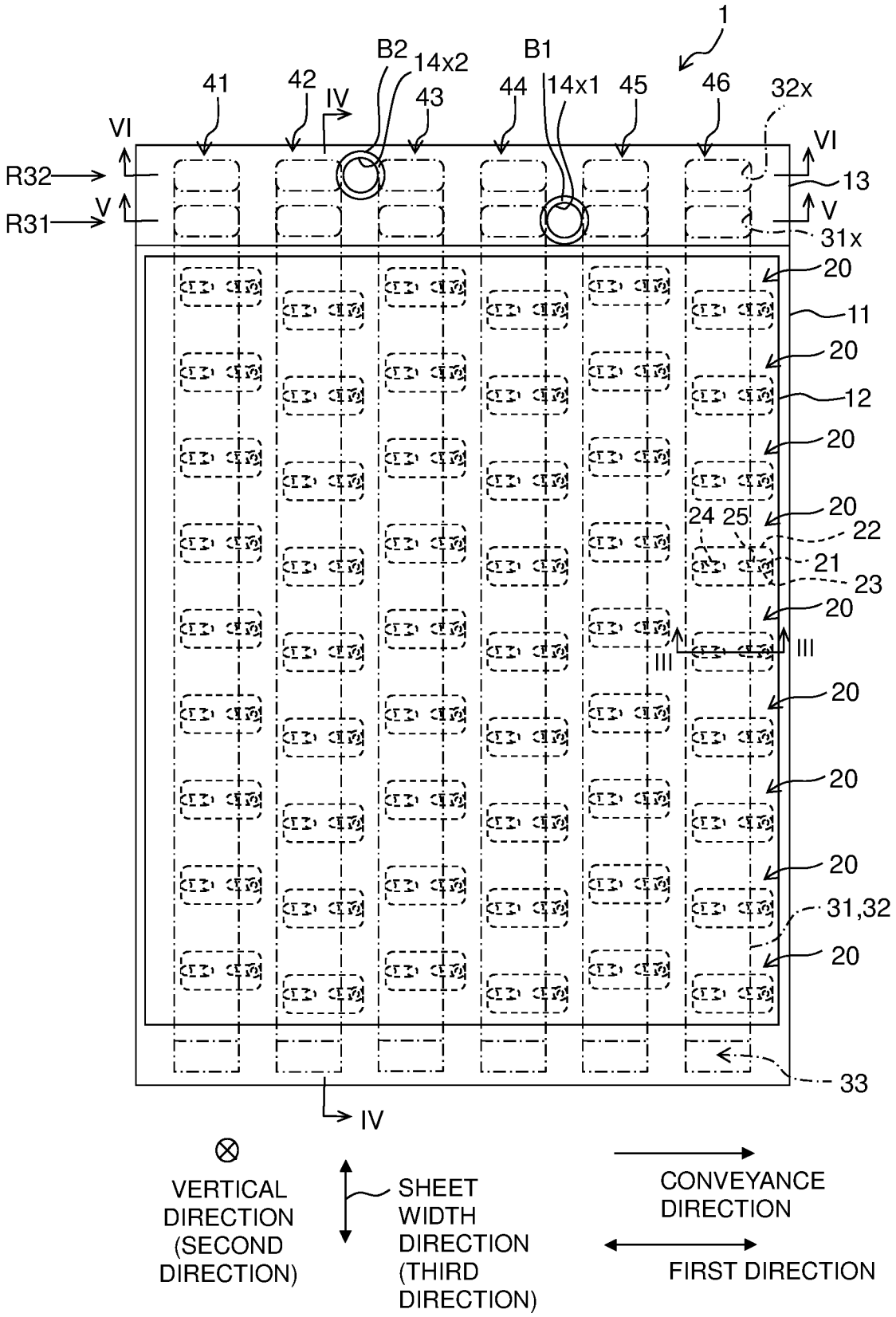
FIG. 2 is a plan view of the head.
Figure 4:
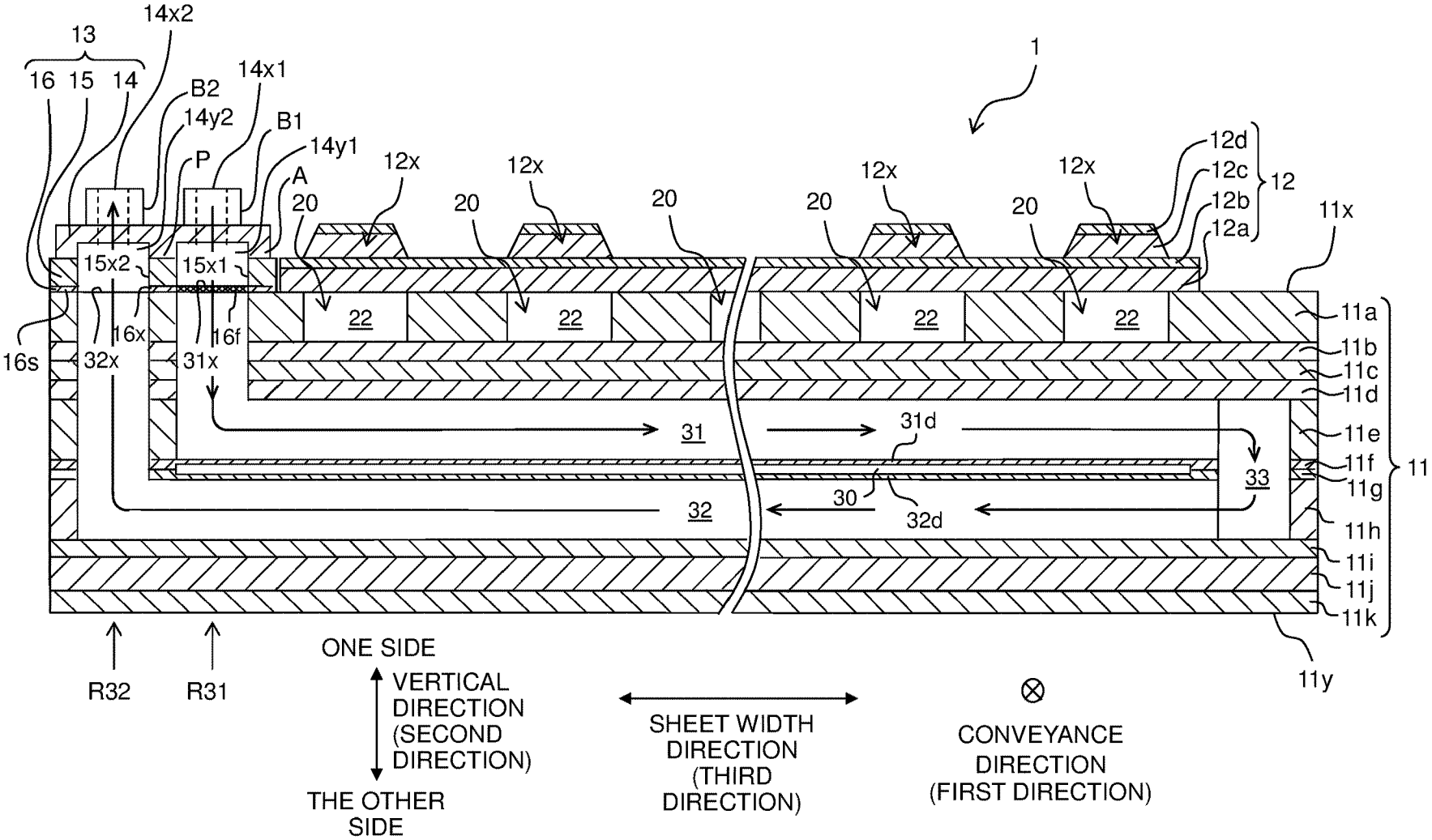
FIG. 4 is a cross-sectional view of the head taken along a line IV-IV in FIG. 2.

As depicted in FIGS. 2 and 4, the head 1 includes a channel substrate 11, an actuator substrate 12, and a joint unit 13.

Figure 3:
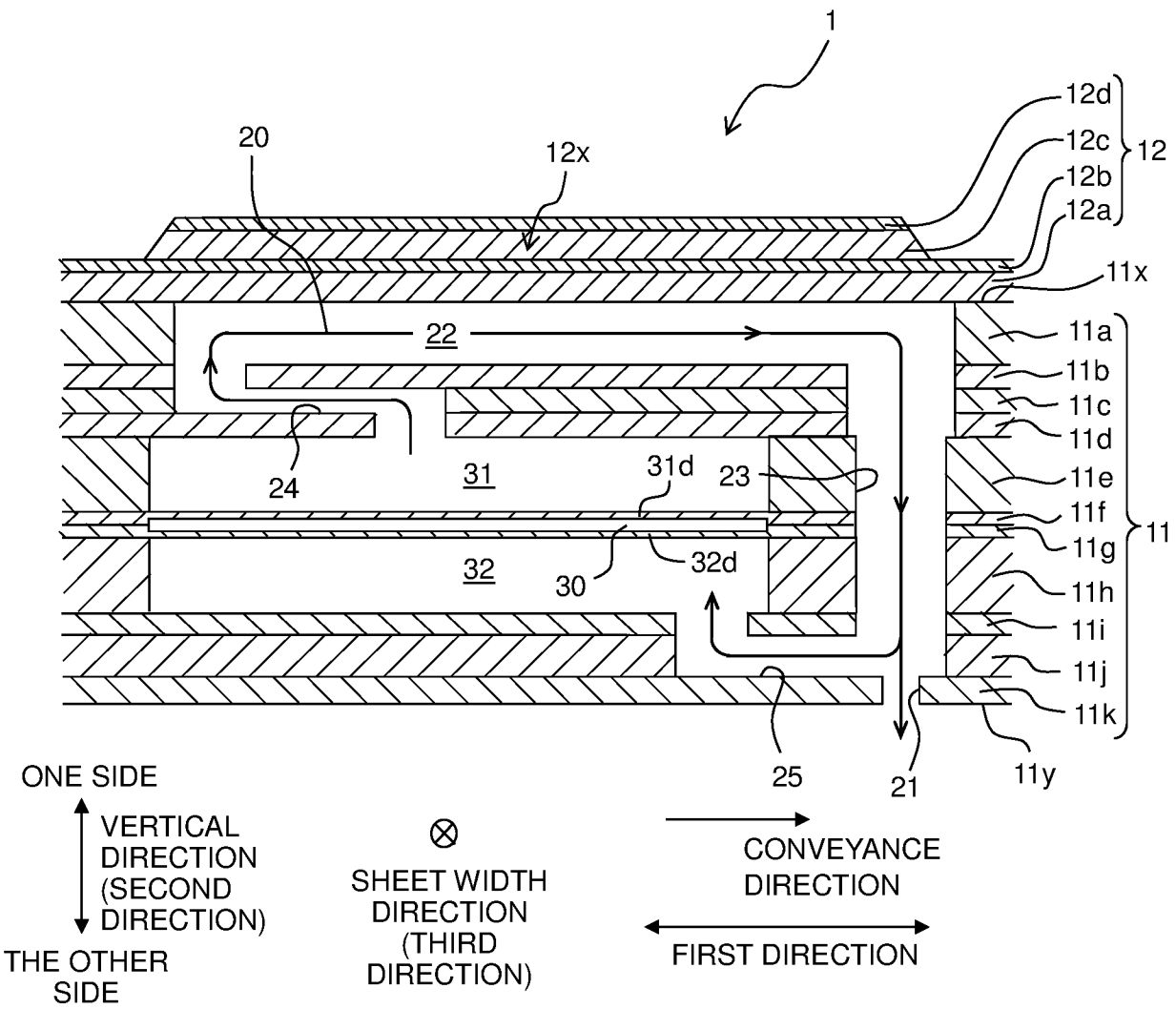
FIG. 3 is a cross-sectional view of the head taken along a line III-III in FIG. 2.

As depicted in FIGS. 3 and 4, the channel substrate 11 includes eleven plates 11*a* to 11*k* that are stacked on top of each other in the vertical direction. The plates 11*a* to 11*k* are adhered to each other. The plates 11*a* to 11*k* are formed to have through holes forming channels. The channels include individual channels 20, supply channels 31, return channels 32, and coupling channels 33.

As depicted in FIG. 2, the channel substrate 11 includes six channel pairs 41 to 46 each formed by the individual channels 20 as well as the supply channel 31, the return channel 32, and the coupling channel 33 that communicate with the individual channels 20. The six channel pairs 41 to 46 are arranged at regular intervals in a direction parallel to the conveyance direction (first direction: a width direction of the supply channels 31 and the return channels 32).

In each of the channel pairs 41 to 46, the supply channel 31 and the return channel 32 are arranged in the vertical direction (second direction, a height direction of the supply channels 31 and the return channels 32, a direction orthogonal to the first direction) and overlap with each other in the vertical direction, as depicted in FIGS. 3 and 4. In each of the channel pairs 41 to 46, the individual channels 20 are arranged to form a row in the sheet width direction (third direction: a longitudinal direction of the supply channels 31 and the return channels 32, a direction orthogonal to the first direction and the second direction), as depicted in FIG. 2.

The supply channels 31 and the return channels 32 extend in the third direction. The length (length in the third direction), the width (length in the first direction), and the height (length in the second direction) of the supply channels 31 are substantially the same as those of the return channels 32.

In each of the channel pairs 41 to 46, the coupling channel 33 couples a first end in the third direction of the supply channel 31 with a first end in the third direction of the return channel 32.

The supply channel 31 and the return channel 32 communicate with a subtank (not depicted) via a supply opening 31*x* provided at a second end in the third direction of the supply channel 31 and a return opening 32*x* provided at a second end in the third direction of the return channel 32 (an upper end in FIG. 2). The supply openings 31*x* and the return openings 32*x* are opened in an upper surface 11*x* of the channel substrate 11.

In each of the channel pairs 41 to 46, the supply opening 31*x* and the return opening 32*x* are formed at the same side in the third direction with respect to the individual channels 20. The supply opening 31*x* and the return opening 32*x* are arranged side by side in the third direction. The supply openings 31*x* are arranged between the individual channels 20 and the return openings 32*x* in the third direction. Namely, an interval in the third direction between the return openings 32*x* and the individual channels 20 is larger than an interval in the third direction between the supply openings 31*x* and the individual channels 20.

The subtank communicates with a main tank containing ink. The subtank contains ink supplied from the main tank. The controller 5 controls and drives a pump (not depicted), which causes ink in the subtank to flow from the supply opening 31*x* into the supply channel 31. The ink flowing into the supply channel 31 flows through the supply channel 31 from the second end (the upper end in FIG. 2, a left end in FIG. 4) toward the first end (a lower end in FIG. 2, a right end in FIG. 4) in the third direction, and then supplied to each individual channel 20 (see FIG. 3). The ink flowing out of each individual channel 20 flows into the return channel 32. The ink reaching the first end (the lower end in FIG. 2, the right end in FIG. 4) in the third direction of the supply channel 31 flows into the return channel 32 through the coupling channel 33. The ink flowing into the return channel 32 flows through the return channel 32 from the first end toward the second end (the upper end in FIG. 2, the left end in FIG. 4) in the third direction, and returns to the subtank via the return opening 32*x*.

As depicted in FIGS. 3 and 4, the supply channel 31 is formed by a through hole in the plate 11*e*. The return channel 32 is formed by a through hole in the plate 11*h*. A damper chamber 30 is provided between the supply channel 31 and the return channel 32 in the second direction. The damper chamber 30 is formed by a recess in the plate 11*f* and a recess in the plate 11*g*. A bottom portion of the recess in the plate 11*f* functions as a damper film 31*d* of the supply channel 31. A bottom portion of the recess in the plate 11*g* functions as a damper film 32*d* of the return channel 32.

As depicted in FIG. 3, each individual channel 20 includes the nozzle 21, a pressure chamber 22, a connection channel 23, an inflow channel 24, and an outflow channel 25.

The nozzle 21 is formed by a through hole in the plate 11*k*. The nozzle 21 is opened in a lower surface 11*y* of the channel substrate 11.

The pressure chamber 22 is formed by a through hole in the plate 11*a*. The pressure chamber 22 is opened in the upper surface 11*x* of the channel substrate 11. The pressure chamber 22 has a substantially rectangular shape that is long in the first direction in a plane parallel to the first direction and the third direction (plane orthogonal to the second direction). A first end in the first direction of the pressure chamber 22 is connected to the inflow channel 24, and a second end in the first direction of the pressure chamber 22 is connected to the connection channel 23.

The connection channel 23 is formed by through holes in the plates 11*b* to 11*j*. The connection channel 23 extends in the second direction. The connection channel 23 is placed between the nozzle 21 and the pressure chamber 22 in the second direction to connect the nozzle 21 and the pressure chamber 22.

The inflow channel 24 is formed by through holes in the plates 11*b* to 11*d*. The inflow channel 24 has an upper end connected to the pressure chamber 22 and a lower end connected to the supply channel 31.

The outflow channel 25 is formed by through holes in the plates 11*i* to 11*j*. The outflow channel 25 has a first end connected to a lower end of the connection channel 23 and a second end connected to the return channel 32.

The inflow channel 24 and the outflow channel 25 are smaller in width than the pressure chamber 22 (the length in the third direction). The inflow channel 24 and the outflow channel 25 function as throttles.

The ink supplied from the supply channel 31 to each individual channel 20 flows into the pressure chamber 22 through the inflow channel 24, flows through the pressure chamber 22 substantially horizontally, and flows into the connection channel 23. The ink flowing into the connection channel 23 moves downward. Part of the ink is discharged from the nozzle 21 and remaining part of the ink flows into the return channel 32 through the outflow channel 25.

Circulating ink between the subtank and the channel substrate 11 as described above discharges air and inhibits the increase in ink viscosity in the supply channels 31, the return channels 32, and the individual channels 20 formed in the channel substrate 11. When ink contains a settling component (a component that may settle, such as pigment), the component is agitated or stirred to inhibit the settling.

As depicted in FIG. 3, the actuator substrate 12 includes a vibration plate 12*a*, a common electrode 12*b*, piezoelectric bodies 12*c*, and individual electrodes 12*d* in that order from the bottom.

The vibration plate 12*a* and the common electrode 12*b* are placed on the upper surface 11*x* of the channel substrate 11 to cover all the pressure chambers 22 formed in the plate 11*a*. Each of the piezoelectric bodies 12*c* and the individual electrodes 12*d* corresponds to one of the pressure chambers 22, and each of the piezoelectric bodies 12*c* and the individual electrodes 12*d* overlaps in the second direction with the corresponding one of the pressure chambers 22.

The common electrode 12*b* and the individual electrodes 12*d* are electrically connected to the driver IC (not depicted). The driver IC changes electric potential of a certain individual electrode 12*d* included in the individual electrodes 12*d* while maintaining the electric potential of the common electrode 12*b* at a ground potential. Specifically, the driver IC generates a driving signal based on a control signal from the controller 5 and applies the driving signal to the certain individual electrode 12*d*. This changes the electric potential of the certain individual electrode 12*d* between a predefined driving potential and the ground potential. A Portion (actuator 12*x*) included in the vibration plate 12*a* and the piezoelectric body 12*c* and interposed between the individual electrode 12*d* and the pressure chamber 22 is thus deformed to be convex toward the pressure chamber 22. This changes the volume of the pressure chamber 22 to apply pressure to ink in the pressure chamber 22, thus discharging ink from the nozzle 21. The actuator substrate 12 includes actuators 12*x* corresponding to the respective pressure chambers 22.

As depicted in FIG. 2, the joint unit 13 is disposed in an area of the upper surface 11*x* of the channel substrate 11 where the supply openings 31*x* and the return openings 32*x* are opened.

In the upper surface 11*x* of the channel substrate 11, a supply opening row R31 is formed by the six supply openings 31*x* each of which corresponds to one of the six channel pairs 41 to 46. Further, in the upper surface 11*x* of the channel substrate 11, a return opening row R32 is formed by the six return openings 32*x* each of which corresponds to one of the six channel pairs 41 to 46. The six supply openings 31*x* belonging to the supply opening row 31 are arranged in the first direction. The six return openings 32*x* belonging to the return opening row R32 are arranged in the first direction. The supply opening row R31 and the return opening row R32 are arranged in the third direction.

The supply openings 31*x* and the return openings 32*x* correspond to a first opening of the present disclosure. The supply opening row R31 and the return opening row R32 correspond to a first opening row of the present disclosure. The supply opening row R31 corresponds to a first row of the present disclosure, and the return opening row R32 corresponds to a second row of the present disclosure.

The channel substrate 11 corresponds to a first member of the present disclosure, and the upper surface 11*x* corresponds to a surface of the present disclosure. The upper surface 11*x* is parallel to the first direction and orthogonal to the second direction.

Figure 5:
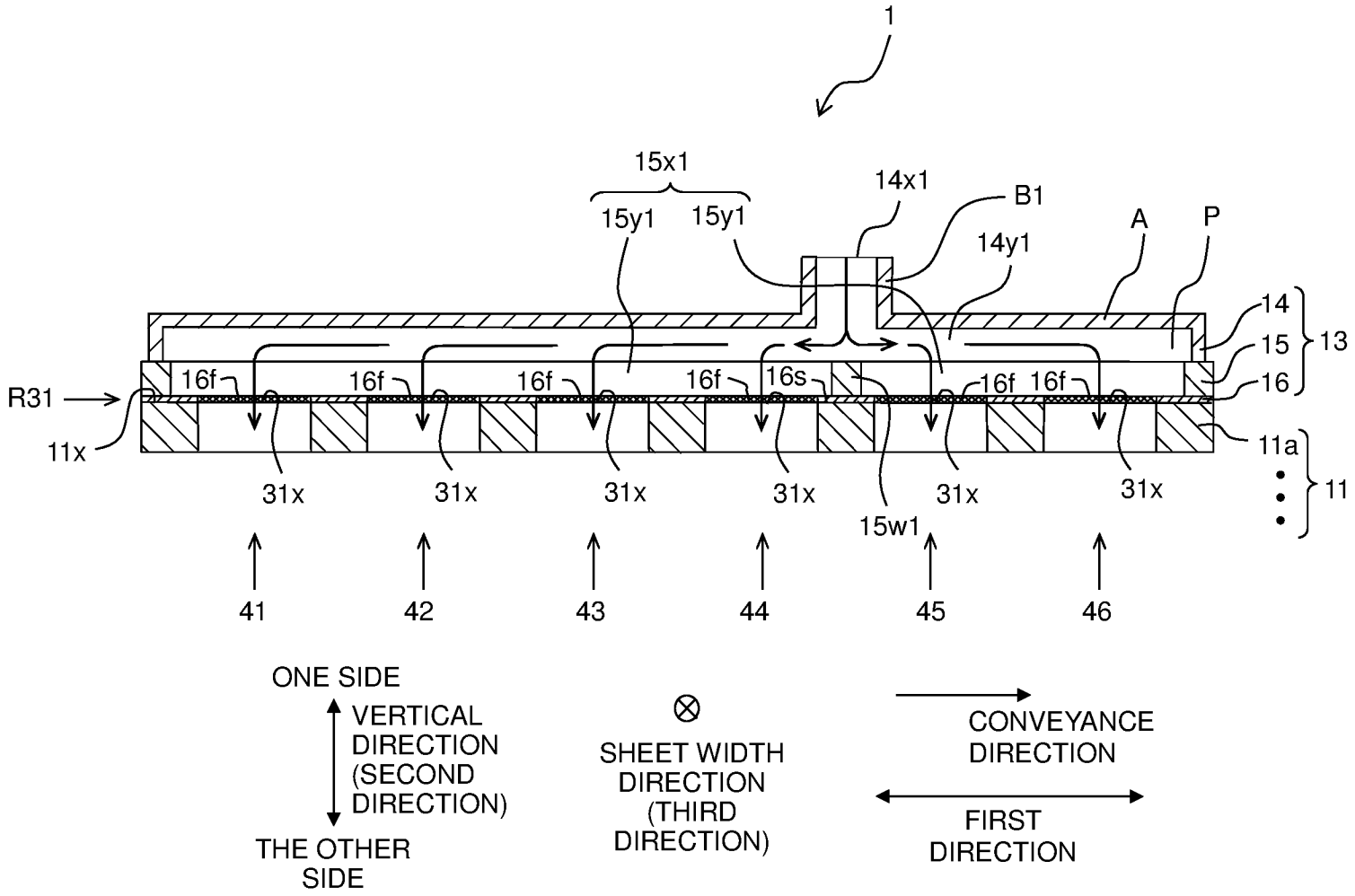
FIG. 5 is a cross-sectional view of the head taken along a line V-V in FIG. 2.
Figure 6:
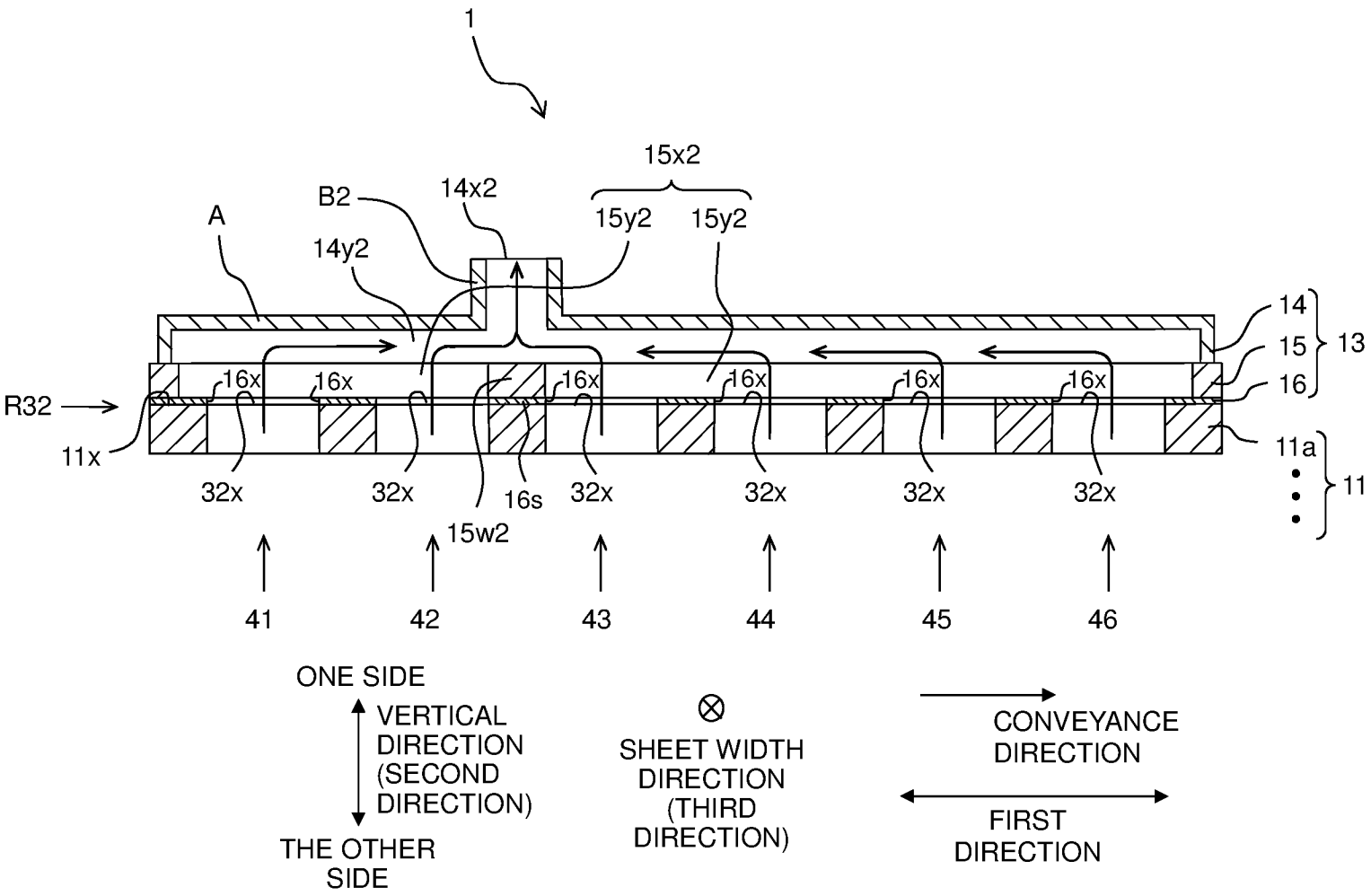
FIG. 6 is a cross-sectional view of the head taken along a line VI-VI in FIG. 2.

As depicted in FIGS. 4 to 6, the joint unit 13 includes a joint member 14, an intermediate member 15, and a filter member 16 in that order from the top. The joint member 14 is disposed at a first side (upper side) in the second direction with respect to the channel substrate 11. The joint member 14 corresponds to a second member of the present disclosure. The intermediate member 15 is disposed between the channel substrate 11 and the joint member 14 in the second direction. The intermediate member 15 corresponds to a third member of the present disclosure. The filter member 16 is disposed between the channel substrate 11 and the intermediate member 15 in the second direction.

The joint member 14 is formed, for example, by injection molding using resin. The joint member 14 includes a main body A and two cylindrical portions B1, B2 formed on an upper surface of the main body A.

The main body A includes two spaces 14*y*1 and 14*y*2 extending in the first direction. A partitioning wall P separates the space 14*y*1 from the space 14*y*2. The space 14*y*1 is provided for the supply opening row R31, and the space 14*y*2 is provided for the return opening row R32. The two spaces 14*y*1 and 14*y*2 are arranged in the third direction. The space 14*y*1 communicates with the six supply openings 31*x* belonging to the supply opening row R31. The space 14*y*2 communicates with the six return openings 32*x* belonging to the return opening row R32.

The cylindrical portion B1 is provided for the space 14*y*1, and the cylindrical portion B2 is provided for the space 14*y*2. The cylindrical portions B1 and B2 are arranged in the third direction. As depicted in FIG. 2, the two cylindrical portions B1 and B2 are separated from each other in the first direction. The cylindrical portion B1 is positioned between a center portion and a first end in the first direction of the joint unit 13. The cylindrical portion B2 is positioned between the center portion and a second end in the first direction of the joint unit 13. Specifically, the cylindrical portion B1 is positioned between the channel pair 44 and the channel pair 45. The cylindrical portion B2 is positioned between the channel pair 42 and the channel pair 43.

The cylindrical portion B1 is connected to a supply tube, and the cylindrical portion B2 is connected to a return tube. The supply tube allows the subtank to communicate with the cylindrical portion B1. The return tube allows the subtank to communicate with the cylindrical portion B2.

An end of the cylindrical portion B1 is formed to have an inlet 14*x*1. An end of the cylindrical portion B2 is formed to have an outlet 14*x*2. As depicted in FIG. 5, the inlet 14*x*1 communicates with the space 14*y*1 via a space of the cylindrical portion B1. As depicted in FIG. 6, the outlet 14*x*2 communicates with the space 14*y*2 via a space of the cylindrical portion B2.

The inlet 14*x*1 and the outlet 14*x*2 are positioned at the first side (upper side) in the second direction with respect to the spaces 14*y*1 and 14*y*2. The inlet 14*x*1 and the outlet 14*x*2 correspond to a second opening of the present disclosure.

The intermediate member 15 is a plate made from metal or the like. As depicted in FIGS. 4 to 7, the intermediate member 15 has two communicating holes 15*x*1 and 15*x*2 extending in the first direction.

The communicating hole 15*x*1 is provided for the supply opening row R31, and the communicating hole 15*x*2 is provided for the return opening row R32. The communicating holes 15*x*1 and 15*x*2 are arranged in the third direction. As depicted in FIG. 5, the communicating hole 15*x*1 communicates with the six supply openings 31*x* belonging to the supply opening row R31. The communicating hole 15*x*1 allows the six supply openings 31*x* to communicate with the space 14*y*1. As depicted in FIG. 6, the communicating hole 15*x*2 communicates with the six return openings 32*x* belonging to the return opening row R32. The communicating hole 15*x*2 allows the six return openings 32*x* to communicate with the space 14*y*2.

Figure 7:
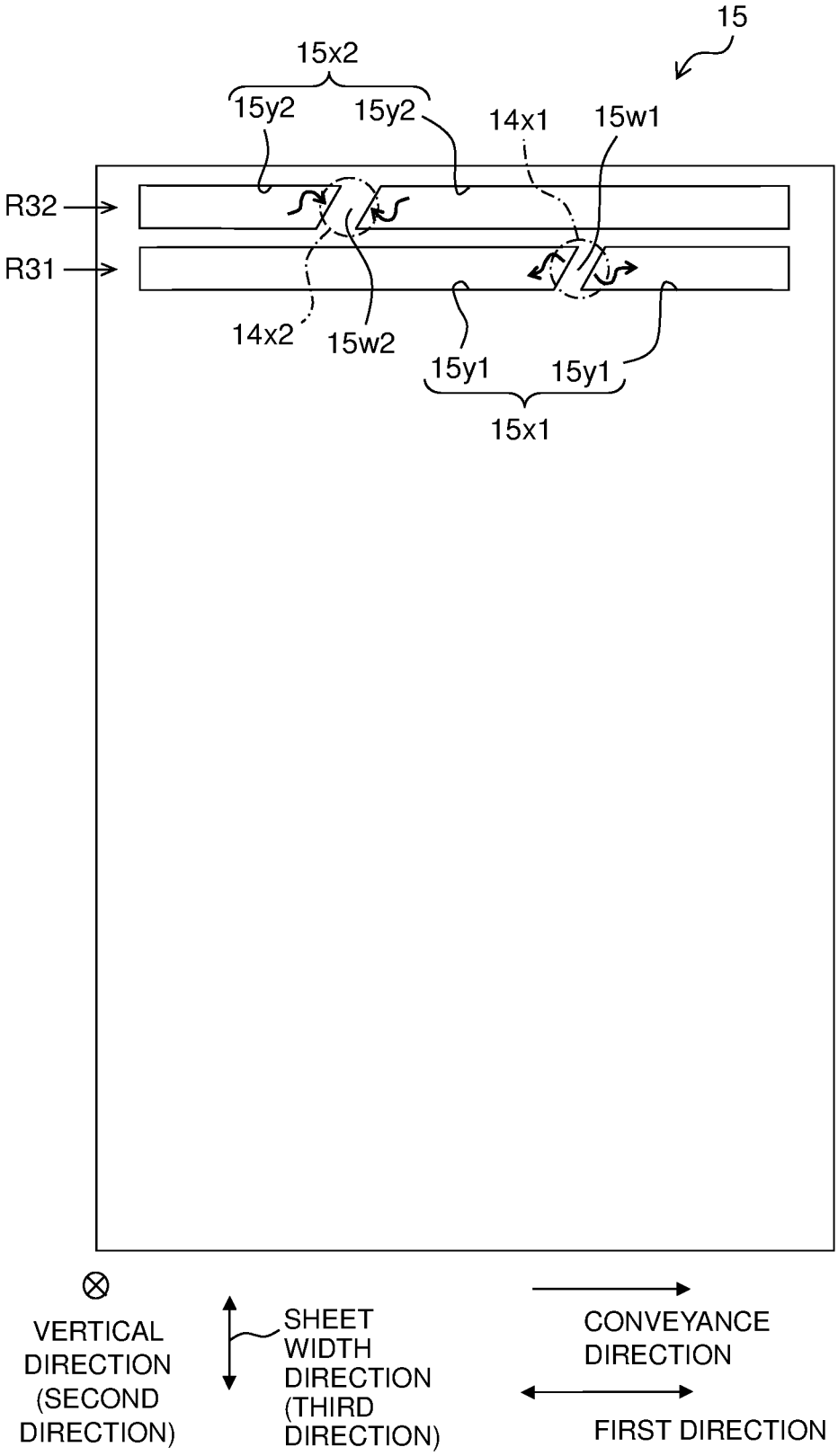
FIG. 7 is a plan view of an intermediate member of the head.

The intermediate member 15 further includes two walls 15*w*1 and 15*w*2. As depicted in FIGS. 5 and 7, the wall 15*w*1 divides the communicating hole 15*x*1 into two partial holes 15*y*1 separated from each other in the first direction. As depicted in FIGS. 6 and 7, the wall 15*w*2 divides the communicating hole 15*x*2 into two partial holes 15*y*2 separated from each other in the first direction.

One (left in FIG. 5) of the two partial holes 15*y*1 overlaps in the second direction with the supply openings 31*x* of the four channel pairs 41 to 44. The other (right in FIG. 5) of the two partial holes 15*y*1 overlaps in the second direction with the supply openings 31*x* of the two channel pairs 45 and 46.

One (left in FIG. 6) of the two partial holes 15*y*2 overlaps in the second direction with the return openings 32*x* of the two channel pairs 41 and 42. The other (right in FIG. 6) of the two partial holes 15*y*2 overlaps in the second direction with the return openings 32*x* of the four channel pairs 43 to 46.

The wall 15*w*1 is provided for the communicating hole 15*x*1, and the wall 15*w*2 is provided for the communicating hole 15*x*2. The walls 15*w*1 and 15*w*2 are arranged in the third direction. As depicted in FIGS. 5 to 7, the two walls 15*w*1 and 15*w*2 are separated from each other in the first direction. The wall 15*w*1 overlaps in the second direction with the inlet 14*x*1. The wall 15*w*2 overlaps in the second direction with the outlet 14*x*2.

As depicted in FIG. 7, the two walls 15*w*1 and 15*w*2 extend in an oblique direction (direction intersecting with the third direction and the first direction). Each of the two walls 15*w*1 and 15*w*2 is a parallelogram in a plane parallel to the first direction and the third direction (plane orthogonal to the second direction). The wall 15*w*1 provided for the supply opening row R31 is smaller in width (length in the first direction) than the wall 15*w*2 provided for the return opening row R32.

The filter member 16 is a thin plate made from metal or the like. As depicted in FIGS. 4 to 6, the filer member 16 includes six filters 16*f*, filter support portions 16*s* supporting the six filters 16*f*, and six through holes 16*x* formed in the filter support portions 16*s*. Fine pores (filter pores) are densely formed in each filter 16*f*. The filters 16*f* are arranged at positions overlapping in the second direction with the six supply openings 31*x* that belong to the supply opening row R31. Since the filter pores of the filters 16*f* may catch air and inhibit the discharge of air, the filters 16*f* are not arranged at positions overlapping in the second direction with the six return openings 32*x* that belong to the return opening row R32. Instead of the filters 16*f*, the through holes 16*x* are arranged at the positions.

As depicted in FIG. 5, the wall 15*w*1 adheres to part of the filter support portion 16*s* between the filter 16*f* corresponding to the channel pair 44 and the filter 16*f* corresponding to the channel pair 45. The wall 15*w*1, the part of the filter support portion 16*s* between the two filters 16*f*, and a wall of the plate 11*a* between the supply opening 31*x* of the channel pair 44 and the supply opening 31*x* of the channel pair 45 are stacked on top of each other in the second direction.

As depicted in FIG. 6, the wall 15*w*2 adheres to part of the filter support portion 16*s* between the through hole 16*x* corresponding to the channel pair 42 and the through hole 16*x* corresponding to the channel pair 43. The wall 15*w*2, the part of the filter support portion 16*s* between the two through holes 16*x*, and a wall of the plate 11*a* between the return opening 32*x* of the channel pair 42 and the return opening 32*x* of the channel pair 43 are stacked on top of each other in the second direction.

Neither the filters 16*f* nor the through holes 16*x* are arranged at positions overlapping in the second direction with the walls 15*w*1 and 15*w*2.

Flowing of ink through the joint unit 13 is explained below.

When the controller 5 controls and drives the pump (not depicted), ink in the subtank flows from the inlet 14*x*1 into the cylindrical portion B1 via the supply tube. As depicted in FIG. 5, ink flowing into the cylindrical portion B1 reaches the space 14*y*1, is divided immediately above the wall 15*w*, and flows into the two partial holes 15*y*1. Ink flowing into one (left in FIG. 5) of the two partial holes 15*y*1 passes through the four filters 16*f* and flows into the supply openings 31*x* of the four channel pairs 41 to 44. Ink flowing into the other (right in FIG. 5) of the two partial holes 15*y*1 passes through the two filters 16*f* and flows into the supply openings 31*x* of the two channel pairs 45 and 46.

As depicted in FIG. 6, ink flowing from the return openings 32*x* of the two channel pairs 41 and 42 flows into one (left in FIG. 6) of the two partial holes 15*y*2 through the two through holes 16*x*, passes through the space 14*y*2, and flows immediately above the wall 15*w*2. Ink flowing from the return openings 32*x* of the four channel pairs 43 to 46 flows into the other (right in FIG. 6) of the two partial holes 15*y*2 through the four through holes 16*x*, passes through the space 14*y*2, and flows immediately above the wall 15*w*2. Ink flowing from the returning opening 32*x* of the two channel pairs 41 and 42 and ink flowing from the return openings 32*x* of the four channel pairs 43 to 46 join together immediately above the wall 15*w*2 in the space 14*y*2. The ink joined immediately above the wall 15*w*2 passes through the cylindrical portion B2, flows out of the outlet 14*x*2, and returns to the sub tank via the return tube.

As described above, in this embodiment, the six supply openings 31*x* and the six return openings 32*x* are arranged in the first direction in the upper surface 11*x* of the channel substrate 11, as depicted in FIGS. 5 and 6. The intermediate member 15 disposed between the channel substrate 11 and the joint member 14 in the second direction is formed to have the communicating hole 15*x*1 that extends in the first direction and the communicating hole 15*x*2 that extends in the first direction. The communicating hole 15*x*1 allows the six supply openings 31*x* to communicate with the space 14*y*1 of the joint member 14. The communicating hole 15*x*2 allows the six return openings 32*x* to communicate with the space 14*y*2 of the joint member 14. The intermediate member 15 further includes the walls 15*w*1 and 15*w*2. The wall 15*w*1 divides the communicating hole 15*x*1 into the two partial holes 15*y*1 separated from each other in the first direction. The wall 15*w*2 divides the communicating hole 15*x*2 into the two partial holes 15*y*2 separated from each other in the first direction. The wall 15*w*1 that divides the communicating hole 15*x*1 into the partial holes 15*y*1 and the wall 15*w*2 that divides the communicating hole 15*x*2 into the partial holes 15*y*2 improve the rigidity of the intermediate member 15 and inhibit the decrease in the flatness of the intermediate member 15.

The wall 15*w*1 overlaps in the second direction with the inlet 14*x*1 (see FIG. 5). In that configuration, ink flowing from the inlet 14*x*1 is divided by the wall 15*w*1 to be smoothly guided to the partial holes 15*y*1. The generation of air is effectively inhibited by allowing ink to smoothly flow from the inlet 14*x*1 to the partial holes 15*y*1. The wall 15*w*2 overlaps in the second direction with the outlet 14*x*2 (see FIG. 6). In that configuration, ink flowing from the partial holes 15*y*2 is smoothly guided to the outlet 14*x*2 positioned above the wall 15*w*2. The dischargeability (discharge performance) of air is improved by allowing ink to smoothly flow from the partial holes 15*y*2 to the outlet 14*x*2.

The walls 15*w*1 and 15*w*2 extend obliquely (see FIG. 7). In that configuration, ink flows smoothly along side surfaces of the walls 15*w*1 and 15*w*2 extending obliquely (see arrows in FIG. 7). This reliably inhibits the generation of air and improves the dischargeability of air.

The filters 16*f* are arranged at positions overlapping in the second direction with the supply openings 31*x* (see FIG. 5). In that configuration, the filters 16*f* catch foreign matter and inhibit the foreign matter from entering the individual channels 20.

The filter 16*f* are not arranged at positions overlapping in the second direction with the walls 15*w*1 and 15*w*2. The filter support portions 16*s* are arranged at the positions (see FIGS. 5 and 6). In that configuration, adhesion areas of the walls 15*w*1 and 15*w*2 are larger than a case in which the walls 15*w*1 and 15*w*2 adhere to the filters 16*f*, thus enhancing adhesive strength.

The supply opening row R31 and the return opening row R32 are arranged in the third direction (see FIG. 2). The spaces 14*y*1 and 14*y*2 are provided for the supply opening row R31 and the return opening row R32, respectively. The spaces 14*y*1 and 14*y*2 are arranged in the third direction (see FIG. 4). The communicating holes 15*x*1 and 15*x*2 are provided for the supply opening row R31 and the return opening row R32, respectively. The communicating holes 15*x*1 and 15*x*2 are arranged in the third direction. In that configuration, the ink flowing direction in the supply opening row R31 may be different from the ink flowing direction in the return opening row R32. Or, although not adopted in this embodiment, the ink flowing through the supply opening row R31 may be different in kind from the ink flowing through the return opening row R32.

The two second openings (inlet 14*x*1 and outlet 14*x*2) provided for the two spaces 14*y*1 and 14*y*2 adjacent to each other in the third direction are separated from each other in the first direction (see FIG. 2 and FIGS. 4 to 6). This inhibits the tube connected to one of the second openings (inlet 14*x*1) from coming into contact with the tube connected to the other (outlet 14*x*2) in the first direction. Further, a distance in the third direction between the two second openings (inlet 14*x*1 and outlet 14*x*2) can be shortened, thus downsizing the entire channel including the spaces 14*y*1, 14*y*2 and the second openings (inlet 14*x*1 and outlet 14*x*2) in the third direction.

The filters 16*f* are arranged at the positions overlapping in the second direction with the six supply openings 31*x* that belong to the supply opening row R31 (see FIG. 5). The filters 16*f* are not arranged at the positions overlapping in the second direction with the six return openings 32*x* that belong to the return opening row R32 (see FIG. 6). The width (length in the first direction) of the wall 15*w*1 provided for the supply opening row R31 is smaller than that of the wall 15*w*2 provided for the return opening row R32 (see FIG. 7). This makes the areas of the filters 16*f* large.

Second Embodiment

Figure 8:
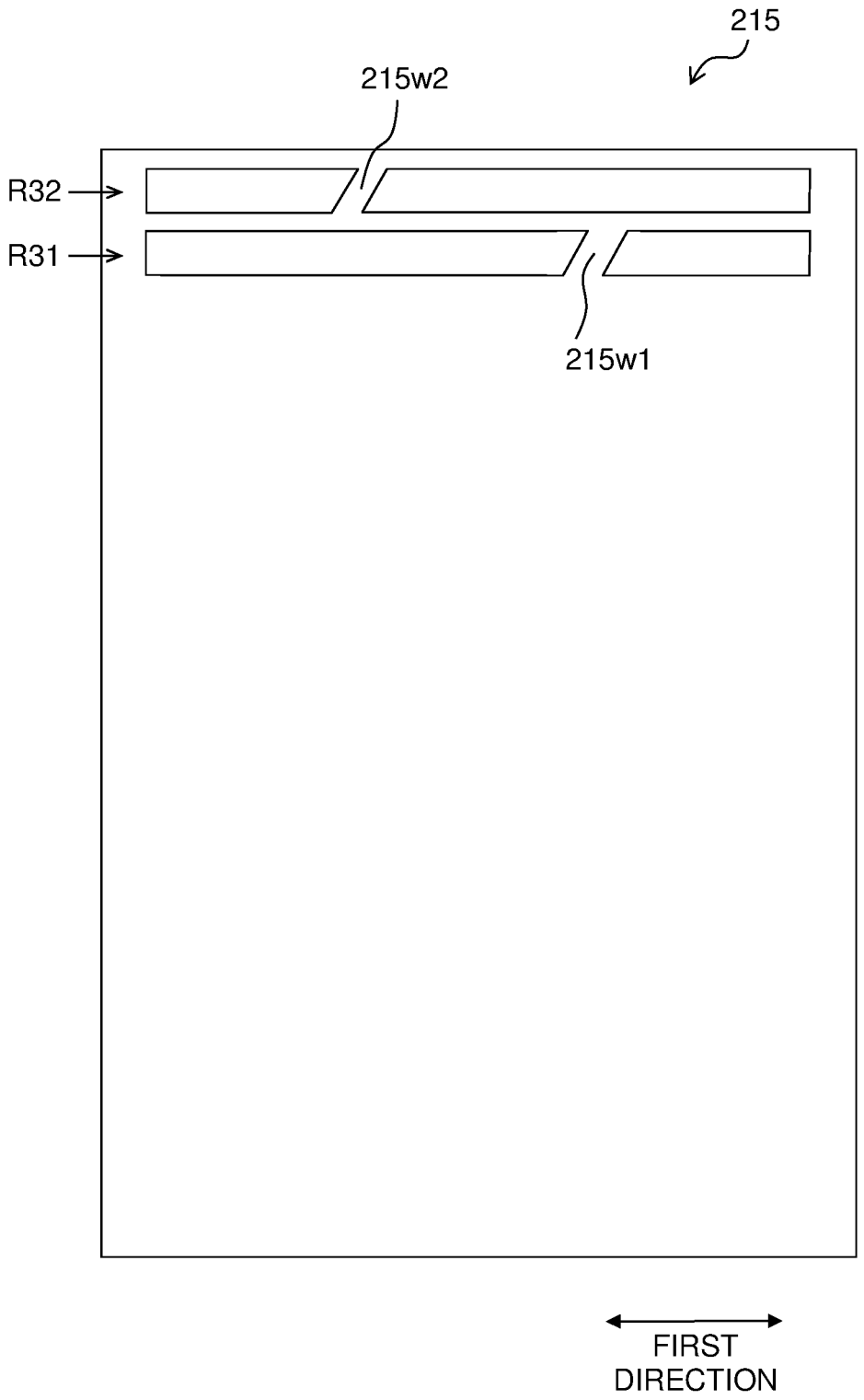
FIG. 8 is a plan view of an intermediate member of a head according to the second embodiment of the present disclosure.

Referring to FIG. 8, a head according to the second embodiment of the present disclosure is explained below.

In the first embodiment (FIG. 7), the width (length in the first direction) of the wall 15*w*1 provided for the supply opening row R31 is smaller than that of the wall 15*w*2 provided for the return opening row R32. In the second embodiment (FIG. 8), a width (length in the first direction) of a wall 215*w*1 provided for the supply opening row R31 is larger than that of a wall 215*w*2 provided for the return opening row R32.

Although the configuration of the walls of the second embodiment is different from that of the first embodiment, the second embodiment can obtain similar effects as the first embodiment when satisfying similar requirements as the first embodiment.

Since great pressure generated by flowing of ink is applied to the wall 215*w*1 provided for the supply opening row R31 in this embodiment, the wall 215*w*1 has a large width. This results in the rigidity of the wall 215*w*1 and inhibits the damage in the wall 215*w*1.

Third Embodiment

Figure 9:
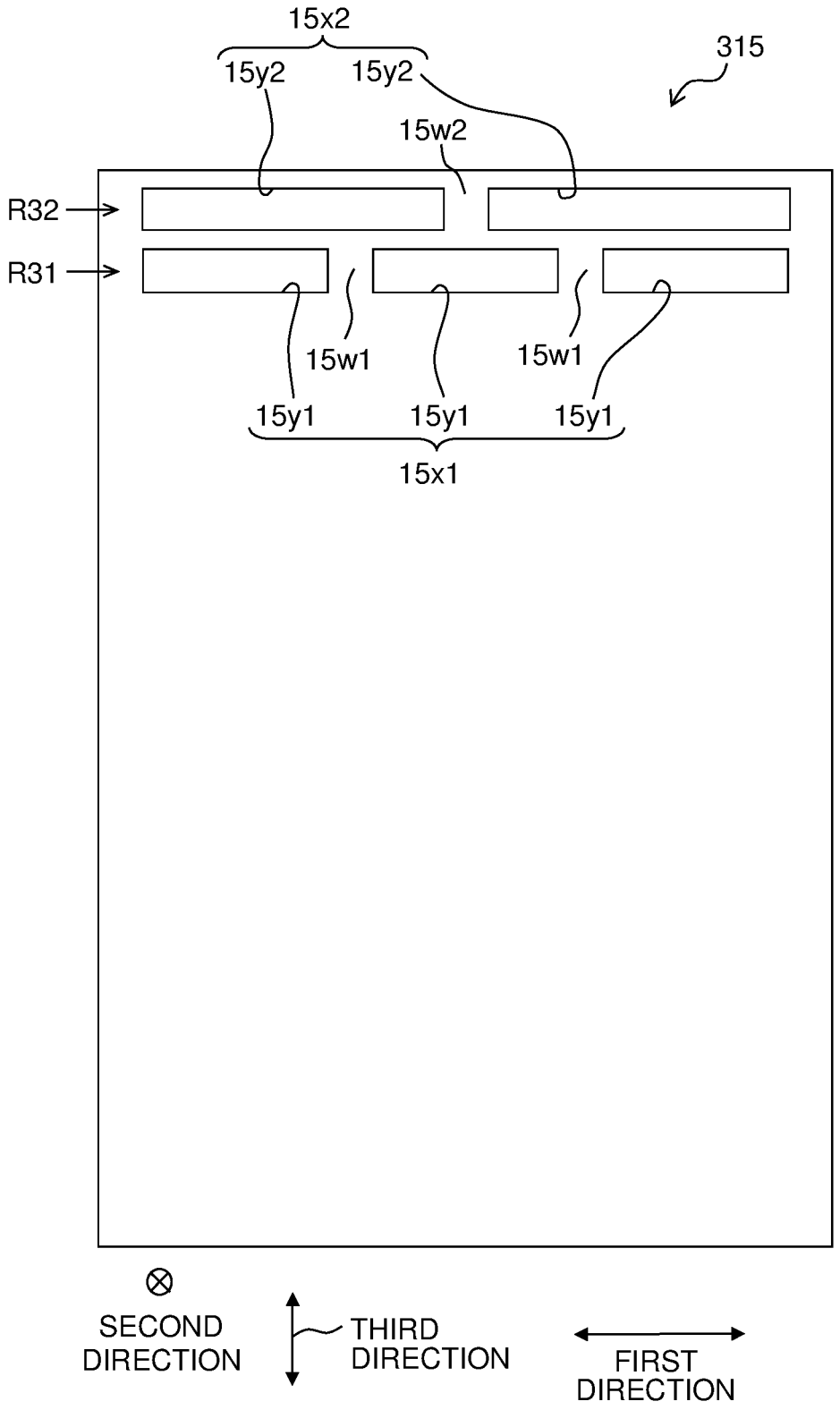
FIG. 9 is a plan view of an intermediate member of a head according to the third embodiment of the present disclosure.

Referring to FIG. 9, a head according to the third embodiment of the present disclosure is explained below.

In the first embodiment (FIG. 7), the wall 15*w*1 divides the communicating hole 15*x*1 into the two partial holes 15*y*1. In the third embodiment (FIG. 9), two walls 15*w*1 divide the communicating hole 15*x*1 into three partial holes 15*y*1.

In the first embodiment (FIG. 7), the wall 15*w*1 provided for the communicating hole 15*x*1 and the wall 15*w*2 provided for the communicating hole 15*x*2 extend obliquely. In the third embodiment (FIG. 9), two walls 15*w*1 provided for the communicating hole 15*x*1 and the wall 15*w*2 provided for the communicating hole 15*x*2 extend in the third direction. Thus, each of the three partial holes 15*y*1 and two partial holes 15*y*2 has a rectangular shape that is long in the first direction in a plane orthogonal to the second direction.

The two walls 15*w*1 provided for the communicating hole 15*x*1 and the wall 15*w*2 provided for the communicating hole 15*x*2 are arranged zigzag in the first direction. The two walls 15*w*1 and the wall 15*w*2 are arranged in the third direction similar to the rows R31 and R32, and the wall 15*w*2 is positioned between the two walls 15*w*1 in the first direction.

Although the configuration of the walls of the third embodiment is different from that of the first embodiment, the third embodiment can obtain similar effects as the first embodiment when satisfying similar requirements as the first embodiment.

In the third embodiment, the two walls 15*w*1 provided for the communicating hole 15*x*1 and the wall 15*w*2 provided for the communicating hole 15*x*2 are arranged zigzag in the first direction. Since the two walls 15*w*1 and the wall 15*w*2 are arranged to be distributed over the first direction and the third direction, the rigidity and flatness of an intermediate member 315 improve uniformly in a plane orthogonal to the second direction.

In this embodiment, the two walls 15*w*1 are provided for the communicating hole 15*x*1. In this configuration, the walls 15*w*1 provide reinforcing effect of the intermediate member 315 stronger than a case in which one wall 15*w*1 is provided for one communicating hole 15*x*1, which improves the rigidity and flatness of the intermediate member 315.

MODIFIED EXAMPLES

The embodiments of the present disclosure are explained above. The present disclosure, however, is not limited to the above embodiments. Various changes or modifications in design may be made without departing from the claims.

In the third embodiment, two walls 15*w*1 are provided for the communicating hole 15*x*1, and one wall 15*w*2 is provided for the communicating hole 15*x*2. The present disclosure, however, is not limited thereto. For example, one wall 15*w*1 may be provided for the communicating hole 15*x*1, and two walls 15*w*2 may be provided for the communicating hole 15*x*2. The wall 15*w*1 and the two walls 15*w*2 may be arranged zigzag in the first direction.

The number of partial holes defined by the wall(s) may be any number provided that the number is a plural number.

The number of partial holes defined by the wall(s) may be three (see the partial holes 15*y*1 in FIG. 9) or not less than four. Namely, the number of walls provided for one communicating hole may be two (see the walls 15*w*1 in FIG. 9) or three or more.

The walls may be positioned at the positions not to overlap in the second direction with the second openings.

Filters may be placed at positions overlapping in the second direction with the walls.

No filters may be provided for the first openings (supply openings 31*x*).

It is not indispensable that the two second openings (inlet 14*x*1 and outlet 14*x*2 in the above embodiment(s)) communicating with the two spaces adjacent to each other in the third direction are separated from each other in the first direction. For example, the two second openings may be adjacent to each other in the first direction, or the two second openings may overlap with each other in the third direction.

In the above embodiment, the two first opening rows (supply opening row R31 and return opening row R32) are provided. However, three or more of first opening rows may be provided such that spaces and communicating holes are provided for the respective rows. Or, only one opening row may be provided.

The number of nozzles belonging to the respective individual channels is one in the above embodiment. The number of nozzles belonging to the respective individual channels, however, may be two or more.

The liquid discharging head is not limited to the line-type head. The liquid discharging head may be a serial-type head in which liquid is discharged from nozzles on a medium (an object to which liquid is to be discharged) during its movement in a scanning direction parallel to the sheet width direction.

The medium is not limited to the sheet or paper, and may be a cloth, a substrate, and the like.

The liquid discharged from the nozzles is not limited to the ink, and may be any liquid (e.g., a treatment liquid that agglutinates or precipitates constituents of ink).

The present disclosure is applicable to facsimiles, copy machines, multifunction peripherals, and the like without limited to printers. The present disclosure is also applicable to a liquid discharge apparatus used for any other application than the image recording (e.g., a liquid discharge apparatus that forms an electroconductive pattern by discharging an electroconductive liquid on a substrate).

What is claimed is:

1. A liquid discharging head, comprising:

a first member having a surface in which first openings are formed, the first openings being arranged in a first direction parallel to the surface and communicating with individual channels;

a second member disposed at one side in a second direction, which is orthogonal to the surface, with respect to the first member, the second member having: a space that extends in the first direction and communicates with the first openings; and a second opening that is disposed at the one side in the second direction with respect to the space and communicates with the space; and a third member disposed between the first member and the second member in the second direction and having a communicating hole that extends in the first direction and allows the first openings to communicate with the space, wherein the third member has a wall dividing the communicating hole into partial holes separated from each other in the first direction.

2. The liquid discharging head according to claim 1, wherein the wall overlaps in the second direction with the second opening.

3. The liquid discharging head according to claim 1, wherein the wall extends in an oblique direction that is parallel to the surface and intersects with the first direction and a third direction orthogonal to the first direction.

4. The liquid discharging head according to claim 1, further comprising a filter member disposed between the first member and the third member in the second direction, the filter member including: filters each having filtering holes; and a filter support portion configured to support the filters, wherein the filters are arranged at positions overlapping in the second direction with the first openings.

5. The liquid discharging head according to claim 4, wherein the filter support portion is disposed at a position overlapping in the second direction with the wall.

6. The liquid discharging head according to claim 1, wherein the first openings form first opening rows in the first member, the first opening rows arranged in a third direction parallel to the surface and orthogonal to the first direction, spaces including the space are formed in the second member to correspond to the first opening rows respectively, the spaces arranged in the third direction, and communicating holes including the communicating hole are formed in the third member to correspond to the first opening rows respectively, the communicating holes arranged in the third direction.

7. The liquid discharging head according to claim 6, wherein the spaces include two spaces adjacent to each other in the third direction, the second opening is included in second openings communicating with the respective spaces, and two second openings included in the second openings and communicating with the respective two spaces are separated from each other in the first direction.

8. The liquid discharging head according to claim 6, wherein the first opening rows include a first row and a second row, a filter is disposed in a position overlapping in the second direction with the first openings that belong to the first row, no filter is disposed in a position overlapping in the second direction with the first openings that belong to the second row, a length in the first direction of the wall provided corresponding to the first row is shorter than a length in the first direction of the wall provided corresponding to the second row.

9. The liquid discharging head according to claim 6, wherein the first opening rows include a first row and a second row, liquid inflows from the first openings belonging to the first row, the liquid flows out of the first openings belonging to the second row, and a length in the first direction of the wall provided corresponding to the first row is longer than a length in the first direction of the wall provided corresponding to the second row.

10. The liquid discharging head according to claim 6, wherein walls including the wall and provided for the communicating holes are arranged zigzag in the first direction.

11. The liquid discharging head according to claim 1, wherein the third member is provided with walls including the wall and dividing the communicating hole into the partial holes.

* * * * *